US008390556B2

(12) United States Patent
Smith et al.

(10) Patent No.: US 8,390,556 B2
(45) Date of Patent: Mar. 5, 2013

(54) LEVEL SHIFTER FOR USE IN LCD DISPLAY APPLICATIONS

(75) Inventors: Nigel P. Smith, Munich (DE); Byoung-Suk Kim, Seoul (KR); Stefan Reithmaier, Vilsheim (DE)

(73) Assignee: Texas Instruments Deutschland GmbH, Freising (DE)

( * ) Notice: Subject to any disclaimer, the term of this patent is extended or adjusted under 35 U.S.C. 154(b) by 233 days.

(21) Appl. No.: 13/022,317

(22) Filed: Feb. 7, 2011

(65) Prior Publication Data

US 2011/0193839 A1 Aug. 11, 2011

(30) Foreign Application Priority Data

Feb. 9, 2010 (DE) ..... 10 2010 007 351

(51) Int. Cl.
*G09G 3/36* (2006.01)

(52) U.S. Cl. ..... 345/98; 345/99; 345/213

(58) Field of Classification Search ..... 345/87–100, 345/204, 211, 213, 691
See application file for complete search history.

(56) References Cited

U.S. PATENT DOCUMENTS 7,817,172 B2 * 10/2010 Hong et al. ..... 345/691
2007/0216632 A1 * 9/2007 Lee ..... 345/100
2010/0123708 A1 * 5/2010 Jang et al. ..... 345/213
2011/0012891 A1 * 1/2011 Cheng et al. ..... 345/214
2011/0169816 A1 * 7/2011 Hsu et al. ..... 345/213

OTHER PUBLICATIONS

"TPS65192: 9-Channel Level Shifter With Gate Voltage Shaping and Discharge Functions," Texas Instruments, SLVS962, Jul. 2009. URL www.ti.com.
DE Search Report dated Feb. 4, 2011.

* cited by examiner

*Primary Examiner* — Hong Zhou
(74) *Attorney, Agent, or Firm* — William B. Kempler; Wade J. Brady, III; Frederick J. Telecky, Jr.

(57) ABSTRACT

A level shifter for use in LCD display applications is provided which includes a group of separate channels each with a signal input and a signal output and with channel control circuitry supporting gate voltage shaping for improving image quality. The level shifter further has a number of flicker clock inputs. The channel control circuitry of each particular channel in the group comprises logic circuitry combining all of said flicker clock inputs with the signal input of the particular channel and signal inputs form other channels into a gate voltage shaping enable signal for the control circuitry of the particular channel. With this configuration it is possible to use the same level shifter IC with only one flicker clock signal for all phases, regardless of how many, without the need for an additional synchronization signal, or multiple flicker clock signals as is conventional. The level shifter automatically determines which input signal needs to be modified for the gate voltage shaping when the active portion of the flicker clock signal is detected.

20 Claims, 5 Drawing Sheets

LEVEL SHIFTER FOR USE IN LCD DISPLAY APPLICATIONS

CROSS-REFERENCE TO RELATED APPLICATIONS

This patent application claims priority from German Patent Application No. 10 2010 007 351.2, filed Feb. 9, 2010, which is incorporated herein by reference in its entirety.

FIELD OF THE INVENTION

The invention relates to a level shifter for use in LCD display applications.

BACKGROUND OF THE INVENTION

LCD displays need drive voltage levels far above the usual logic high or low levels from a typical application environment. Level shifters are needed to transform the logic levels of the control signals into positive and/or negative drive signals of an appropriate level that depends on a particular LCD display and can reach several tens of volts. Each level shifter channel has low-impedance output stages that achieve fast rise and fall times when driving the capacitive loading typically present in LCD display applications.

Typical level shifters for TVs and monitors may have multiple separate channels, some of which support gate voltage shaping to improve picture quality by reducing image sticking. This is usually implemented by generating flicker clock signals to determine exactly when gate voltage shaping should begin. In LCD displays using Gate-in-Panel technology, one flicker clock is needed for each pair of input signals. Since each pair of input signals is 180° out of phase, one flicker clock can be used for both. For example, a four-phase display requires two flicker clock signals; a six-phase display needs three flicker clock signals and so on.

In practical applications it is not always possible to provide all the flicker clock signals a display requires. This can be because of limited capabilities of the timing controller that generates these signals, or because of the limited number of connections supported by the level shifter IC. Furthermore, the conventional approach described above does not easily allow a system designed for one type of display (e.g. four-phase) also to be used for another (e.g. six-phase). If a dedicated flicker clock signal is not available for each pair of input signals, an additional signal can be generated to synchronize a single flicker clock signal at the start of each picture frame, but at the expense of complexity.

SUMMARY OF THE INVENTION

In one aspect of the invention a level shifter for use in LCD display applications is provided which includes a group of separate channels each with a signal input and a signal output and with channel control circuitry supporting gate voltage shaping for improving image quality. The level shifter further has a number of flicker clock inputs. The channel control circuitry of each particular channel in the group comprises logic circuitry combining all of said flicker clock inputs with the signal input of the particular channel and signal inputs form other channels into a gate voltage shaping enable signal for the control circuitry of the particular channel. With this configuration it is possible to use the same level shifter IC with only one flicker clock signal for all phases, regardless of how many, without the need for an additional synchronization signal, or multiple flicker clock signals as is conventional.

The inventive level shifter automatically determines which input signal needs to be modified for the gate voltage shaping when the active portion of the flicker clock signal is detected.

In an implementation, the logic circuitry comprises an AND gate with inputs to each of which one of the signal inputs is applied, and an OR gate with inputs to each of which one of the flicker clock inputs is applied. The logic circuitry further comprises a flip-flop with a D input to which an output of the AND gate is applied, a clock input to which an output of the OR gate is applied and an output which provides the gate voltage shaping enable signal. Thus, by logically ORing the flicker clock signals generated by a timing controller, a single flicker clock signal is obtained and the level shifter internally always works with only that single flicker clock signal. Therefore, systems can be developed that can be used with any number of phases and any number of flicker clock signals with only minor changes to the application circuit required.

Further aspects of the invention will appear from the appending claims and from the following detailed description given with reference to the appending drawings.

DETAILED DESCRIPTION OF AN EXAMPLE EMBODIMENT

Figure 1:
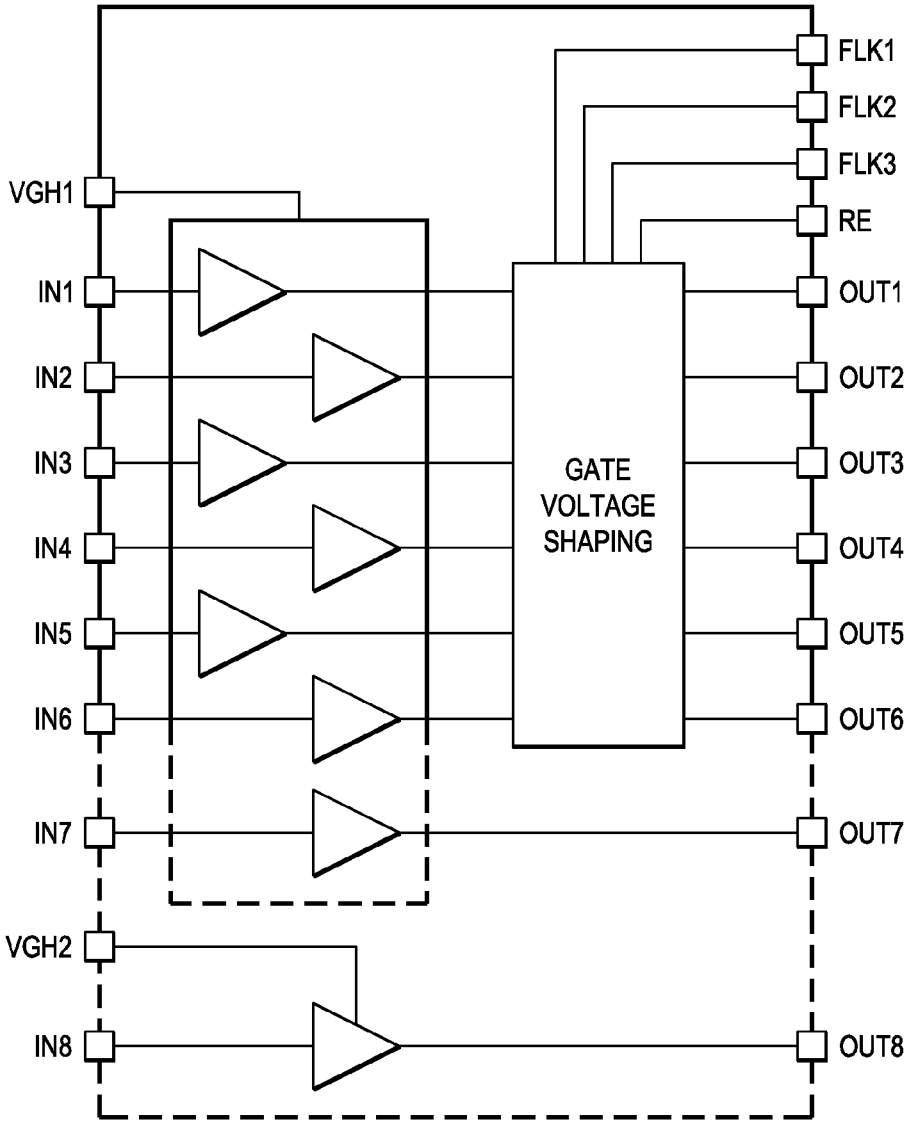
FIG. 1 is a block diagram of a level shifter in which the invention can be implemented.

The level shifter in FIG. 1 is an integrated circuit for use in an LCD display application. It includes a group of six separate channels, each capable of driving one phase of the connected LCD display device. Each channel in the group has an associated signal input IN1 to IN6 and an associated signal output OUT1 to OUT6. Each channel in the group has a driver stage supplied from a supply voltage VGH1 and associated gate voltage shaping circuitry in a gate voltage shaping block. Inputs to the gate voltage shaping block are three flicker clock signals FLK1, FLK2 and FLK3. Terminal RE is a connection for a current sink which can be a discharge resistor. The six channels in the group have channel control circuitry that supports gate voltage shaping as will be further explained. A further channel in the level shifter with signal input IN7 and signal output OUT7 does not support gate voltage shaping, but has a driver stage likewise supplied from VGH1. Further channels in the level shifter such as one with signal input IN8 and signal output OUT8 likewise do not support gate voltage shaping, but has a driver stage supplied from a terminal VGH2.

It should be understood that in an actual implementation of the level shifter, other functionality is typically incorporated such as further channels or functionality for discharging the display panel during power-down. Such functionality being irrelevant to the invention, it will not be disclosed further.

Figure 2:
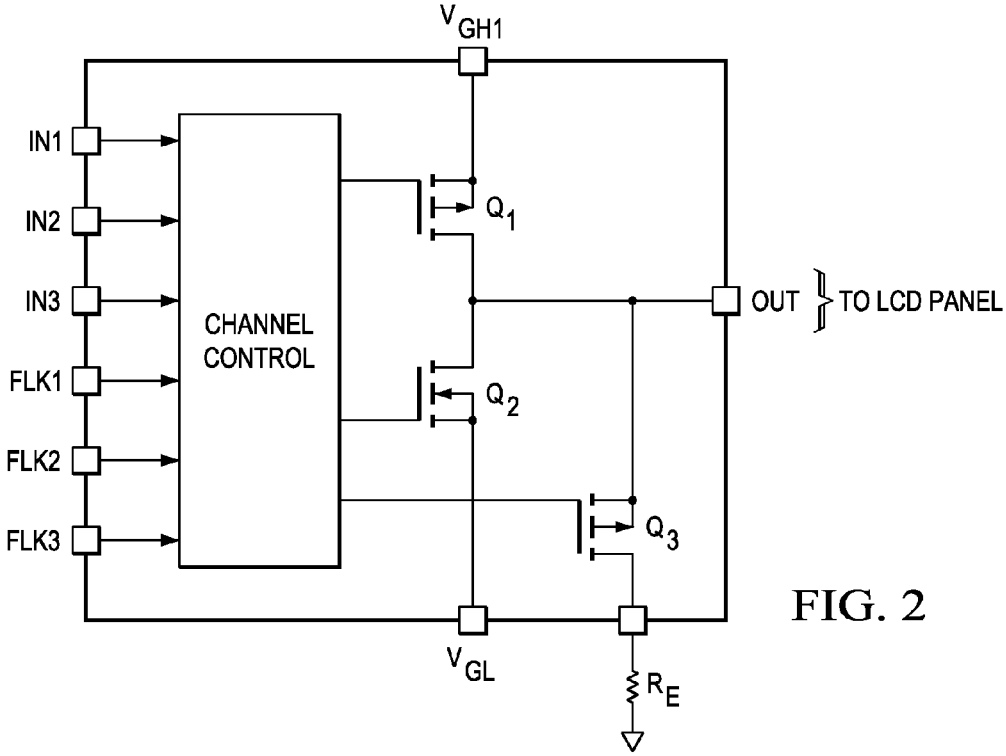
FIG. 2 is a schematic diagram of one channel in the level shifter.

FIG. 2 is a simplified block diagram of a single channel in the group of channels that support gate voltage shaping, channel 1 in this case, all other channels of the group being of identical constitution.

A pair of complementary transistors Q1 and Q2 is connected in series between supply terminals VGH1 and VGL, the interconnection node being connected to the output OUT1 of the channel. Transistors Q1 and Q2 are driven by channel control circuitry which has inputs for three input signals and inputs for the three flicker clock signals FLK1, FLK2, FLK3. In addition to its associated input IN1, the control circuitry of channel 1 receives two further input signals, IN2 and In3. The output OUT1 of the channel goes to a connected LCD panel. The channel control circuitry also drives a further transistor Q3 which, when ON, ties the output terminal OUT1 to terminal RE to which a discharge resistor is connected.

Figure 3:
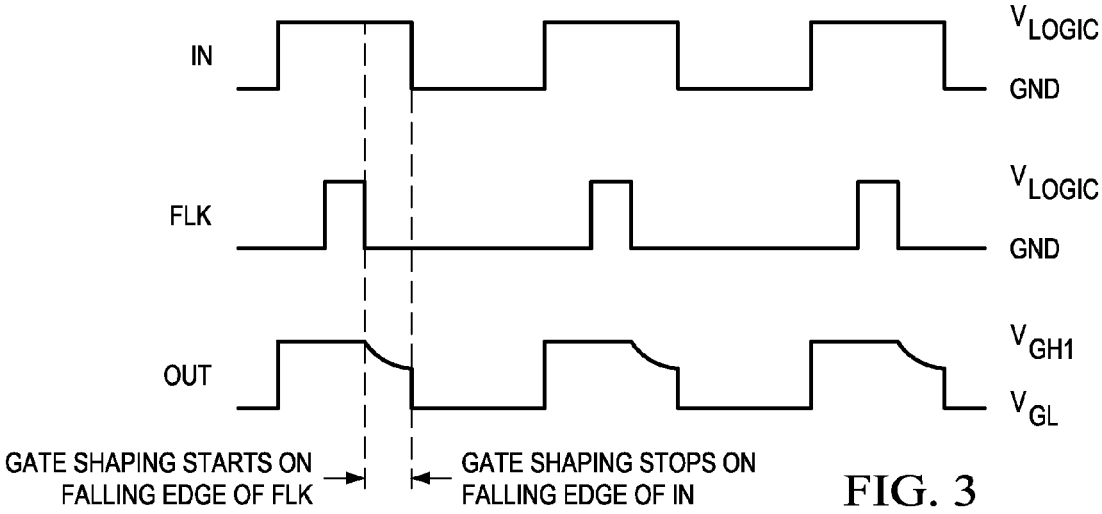
FIG. 3 is a timing diagram illustrating the process of gate voltage shaping.

The diagram in FIG. 3 shows an input signal IN, a flicker clock signal FLK and an output signal OUT; since the diagram illustrates the timing of signals which is the same for all channels, indices are omitted. The input signal is a logic signal that is either on logic level VLOGIC or GND. The flicker clock signal FLK is also a logic signal that is either on logic level VLOGIC or GND. The output signal OUT is the level-shifted signal that varies between VHG1 and VGL. On the rising edge of IN, Q1 shall turn ON, Q2 and Q3 shall turn off and OUT shall be driven to VGH1. On the falling edge of signal FLK, Q1 shall turn OFF, Q3 shall be turned ON and the connected LCD panel shall now discharge through Q3 and the discharge resistor. On the falling edge of input signal IN, Q2 shall turn ON, Q3 shall turn OFF, and OUT shall be driven to VGL. This sequence is repeated in turn for each channel.

The diagram in FIG. 3 is for the case where each channel receives a flicker clock signal and, more specifically, each pair of channels receives one of the three flicker clock signals.

The invention, as will be explained, allows the level shifter to work with one, two or three flicker clock signals, or even without any of them if gate voltage shaping is not intended.

Figure 4:
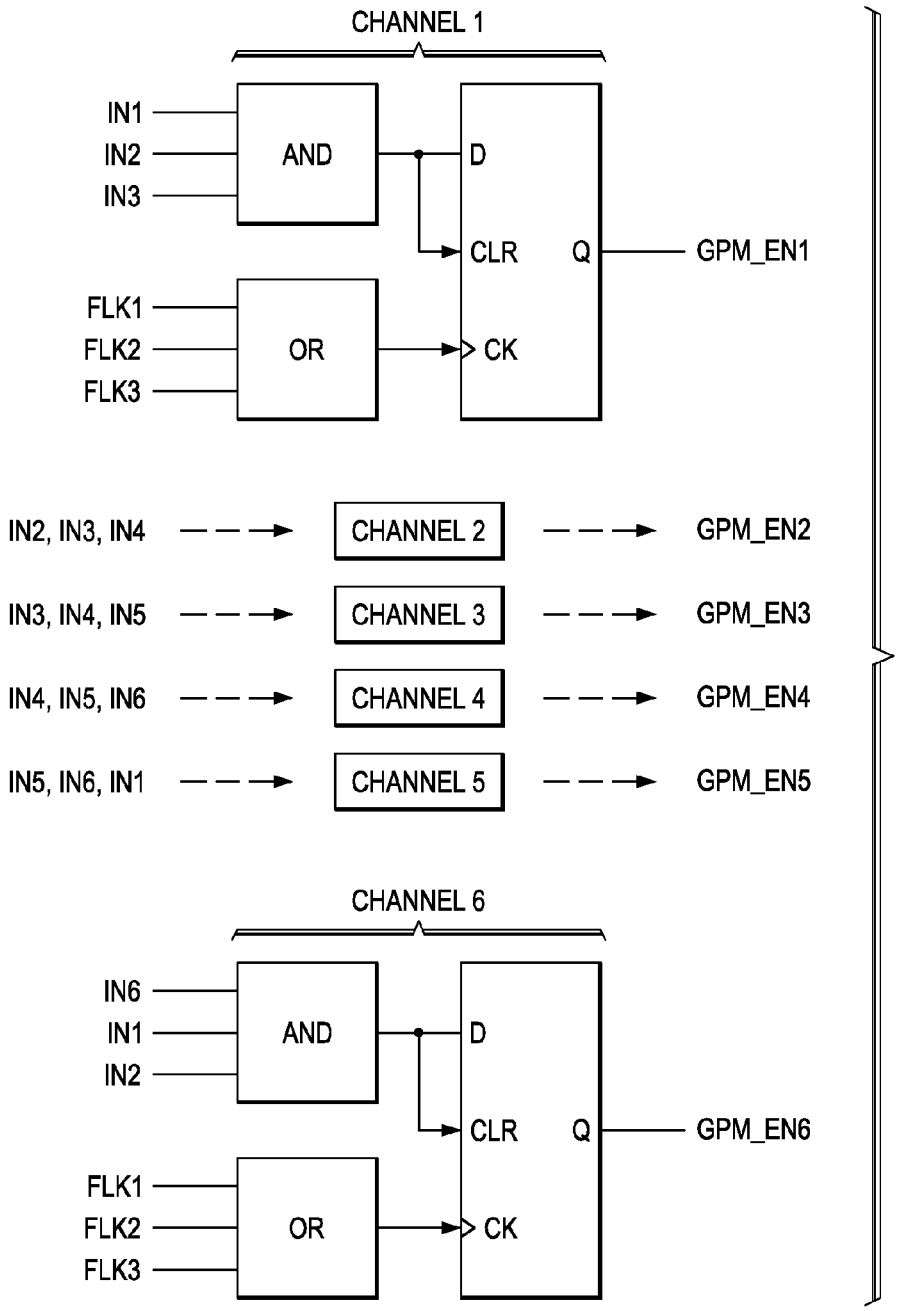
FIG. 4 is a block diagram of logic circuitry contained in the channel control circuits of all channels.

With reference now to FIG. 4, the upper part shows logic circuitry contained in the control circuitry of channel 1, the bottom part shows logic circuitry contained in the control circuitry of channel 6 and in between channels 2 to 5 are symbolized, it being understood that each channel has identical logic circuitry.

Each logic circuitry has an AND gate with inputs to which a selection of input signals is applied, an OR gate with inputs to which all of the flicker clock signals are applied (regardless whether active) and a D-type flip-flop with active low clock signal and active low asynchronous clear. The output of the AND gate is applied to the data input D and to the clear input CLR of the flip-flop and the output of the OR gate is applied to the clock input CK of the flip-flop. The output of the flip-flop is an enable signal GPM_ENx for the particular channel x. The enable signal GPM_ENx is used by the channel control circuitry of the corresponding channel x and has the effect of enabling gate voltage shaping in that channel in the manner illustrated in FIG. 3.

The AND gate of each channel x receives its associated input signal Inx and two further input signals which are those of different channel pairs. With channel pairs channel 1 and channel 4;
channel 2 and channel 5;
channel 3 and channel 6;

where the input signals between each pair are 180° out of phase (although the duty cycles may not be 1:1), the input signals to the channels are as follows:

Channel 1: IN1 & IN2 & IN3
Channel 2: IN2 & IN3 & IN4
Channel 3: IN3 & IN4 & INS
Channel 4: IN4 & IN5 & IN6
Channel 5: IN5 & IN6 & IN1
Channel 6: IN6 & IN1 & IN2.

It should be understood that the above scheme is for a six-phase LCD; on principle, it can be adapted to any number of phases.

Figure 5:
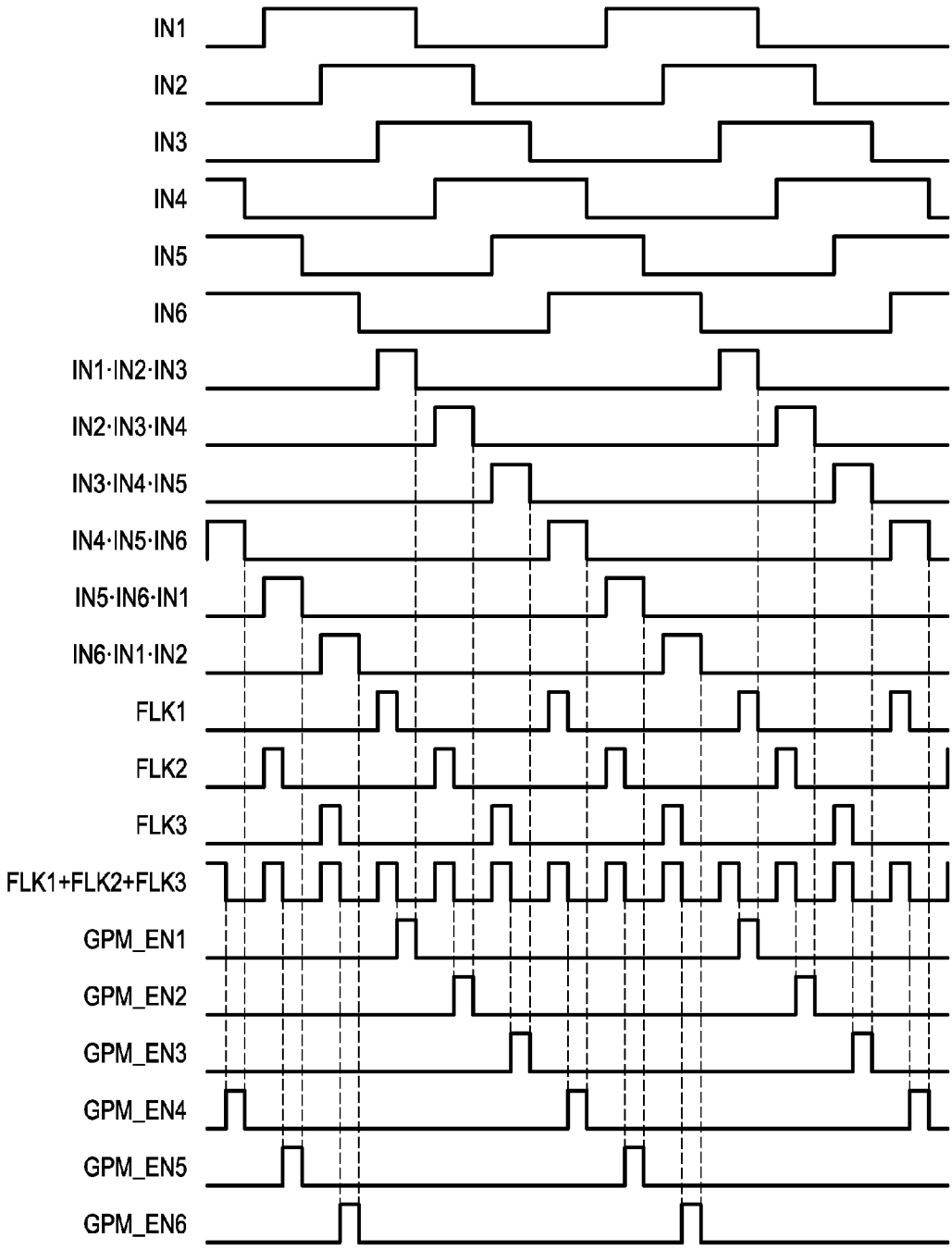
FIG. 5 is a timing diagram illustrating the operation of the level shifter with three separate flicker clock signals.

In operation of the level shifter with three flicker clock signals being available, the timing diagram of signals is as shown in FIG. 5. In the diagram, input signals IN1 to IN6 are shown along with the outputs of the AND gate in each channel, the three flicker clock signals FLK1 to FLK3, the output FLK1+FLK2+FLK3 of the OR gate in each channel and the output GPM_EN 1 to GPM_EN6 of each channel logic circuitry. By comparing FIG. 5 with FIG. 3, it is seen that each channel has the same basic gate voltage shaping functionality as illustrated in FIG. 3. Specifically, for each channel x, the enable signal GPM_ENx is active from the falling edge of the flicker clock signal associated with the channel pair to which channel x belongs, and inactive from the falling edge of the associated input signal Inx.

Figure 6:
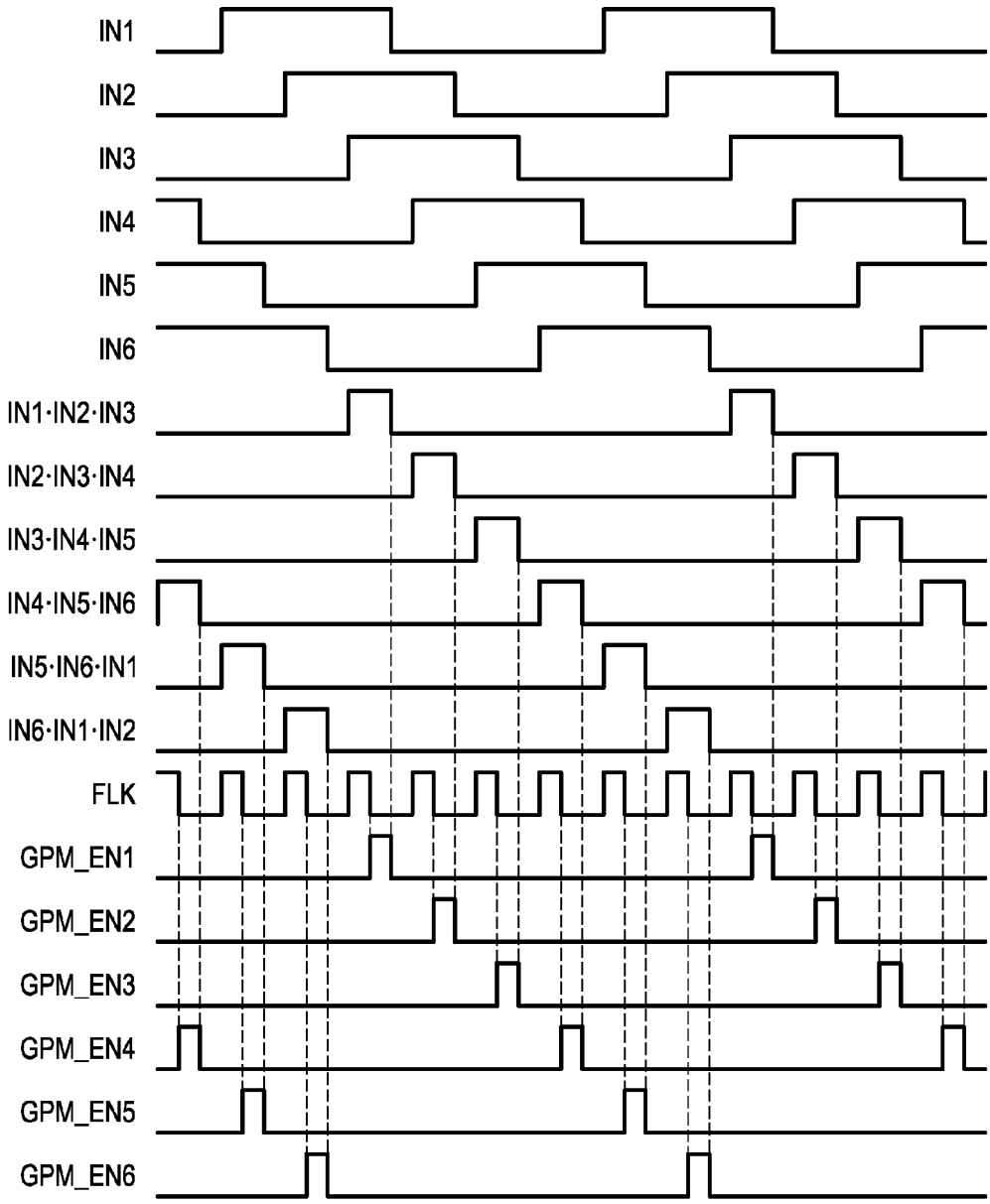
FIG. 6 is a timing diagram illustrating the operation of the level shifter with only one flicker clock signal.

In operation of the level shifter with only one flicker clock signal FLK being available, the timing diagram of signals is as shown in FIG. 6. In FIG. 6, the single flicker clock signal FLK is identical with the signal FLK1+FLK2+FLK3 in FIG. 5 and the signals FLK1 to FLK3 are missing, but all other signals are identical. This illustrates the advantage of the inventive level shifter which ensures the same functionality regarding gate voltage shaping independent of the number of available flicker clock signals. In the case no flicker clock signal is available at all, none of the GPM_ENx signals will ever be active, and no gate voltage shaping will occur.

Although the present invention has been described in detail, it should be understood that various changes, substitutions and alterations can be made thereto without departing from the spirit and scope of the invention as defined by the appended claims.

The invention claimed is:

1. A level shifter for use in LCD display applications, comprising a group of separate channels each with a signal input and a signal output and with channel control circuitry supporting gate voltage shaping for improving image quality; the level shifter further comprising a number of flicker clock inputs, and the channel control circuitry of each particular channel in the group comprising logic circuitry combining all of said flicker clock inputs with the signal input of said particular channel and signal inputs from other channels into a gate voltage shaping enable signal for the control circuitry of the particular channel.

2. The level shifter according to claim 1, wherein the logic circuitry comprises an AND gate with inputs to each of which one of said signal inputs is applied.

3. The level shifter according to claim 2, wherein the logic circuitry comprises a flip-flop with a D-input to which an output of the AND gate is applied, a clock input to which an output of the OR gate is applied and an output which provides the gate voltage shaping enable signal.

4. The level shifter according to claim 3, wherein the number of channels in the group is six and the number of flicker clock inputs is three, and the inputs to the AND gate are as follows Channel 1: input 1, input 2, input 3;
Channel 2: input 2, input 3, input 4;
Channel 3: input 3, input 4, input 5;
Channel 4: input 4, input 5, input 6;
Channel 5: input 5, input 6, input 1;
Channel 6: input 6, input 1, input 2.

5. The level shifter according to claim 3, wherein the gate voltage shaping is active in each channel during the active state of the corresponding gate voltage shaping enable signal to selectively connect the signal output of the channel to a defined discharge sink.

6. The level shifter according to claim 3, and further comprising separate channels with control circuitry not supporting gate voltage shaping.

7. The level shifter according to claim 2, wherein the logic circuitry comprises an OR gate with inputs to each of which one of said flicker clock inputs is applied.

8. The level shifter according to claim 7, wherein the logic circuitry comprises a flip-flop with a D-input to which an output of the AND gate is applied, a clock input to which an output of the OR gate is applied and an output which provides the gate voltage shaping enable signal.

9. The level shifter according to claim 8, wherein the gate voltage shaping is active in each channel during the active state of the corresponding gate voltage shaping enable signal to selectively connect the signal output of the channel to a defined discharge sink.

10. The level shifter according to claim 7, wherein the gate voltage shaping is active in each channel during the active state of the corresponding gate voltage shaping enable signal to selectively connect the signal output of the channel to a defined discharge sink.

11. The level shifter according to claim 2, wherein the gate voltage shaping is active in each channel during the active state of the corresponding gate voltage shaping enable signal to selectively connect the signal output of the channel to a defined discharge sink.

12. The level shifter according to claim 2, and further comprising separate channels with control circuitry not supporting gate voltage shaping.

13. The level shifter according to claim 1, wherein the logic circuitry comprises an OR gate with inputs to each of which one of said flicker clock inputs is applied.

14. The level shifter according to claim 13, wherein the logic circuitry comprises a flip-flop with a D-input to which an output of the AND gate is applied, a clock input to which an output of the OR gate is applied and an output which provides the gate voltage shaping enable signal.

15. The level shifter according to claim 14, wherein the gate voltage shaping is active in each channel during the active state of the corresponding gate voltage shaping enable signal to selectively connect the signal output of the channel to a defined discharge sink.

16. The level shifter according to claim 13, wherein the gate voltage shaping is active in each channel during the active state of the corresponding gate voltage shaping enable signal to selectively connect the signal output of the channel to a defined discharge sink.

17. The level shifter according to claim 13, and further comprising separate channels with control circuitry not supporting gate voltage shaping.

18. The level shifter according to claim 1, wherein the gate voltage shaping is active in each channel during the active state of the corresponding gate voltage shaping enable signal to selectively connect the signal output of the channel to a defined discharge sink.

19. The level shifter according to claim 18, and further comprising separate channels with control circuitry not supporting gate voltage shaping.

20. The level shifter according to claim 1, and further comprising separate channels with control circuitry not supporting gate voltage shaping.

* * * * *